United States Patent [19]

Meihofer et al.

[11] 4,021,031

[45] May 3, 1977

[54] WEB ALIGNMENT SYSTEM

[75] Inventors: Edward F. Meihofer, Norfolk; Tony P. DiGirolamo, Sharon, both of Mass.

[73] Assignee: Butler Automatic, Inc., Canton, Mass.

[22] Filed: Dec. 8, 1975

[21] Appl. No.: 638,433

[52] U.S. Cl. ..... 226/20; 250/561; 242/57.1

[51] Int. Cl.[2] ..... B65H 25/26

[58] Field of Search ..... 226/15–18, 226/20–23, 45, 19; 250/559–563, 571; 242/57.1

[56] References Cited

UNITED STATES PATENTS

| | | | |
|---|---|---|---|
| 3,108,727 | 10/1963 | Farber | 226/20 |
| 3,198,951 | 8/1965 | Lentze | 250/563 |
| 3,225,988 | 12/1965 | Drenning | 226/45 X |
| 3,458,707 | 7/1969 | Nichols | 250/563 |

FOREIGN PATENTS OR APPLICATIONS

| | | | |
|---|---|---|---|
| 1,191,591 | 4/1965 | Germany | 250/560 |

*Primary Examiner*—Robert W. Saifer
*Attorney, Agent, or Firm*—Cesari and McKenna

[57] ABSTRACT

A system for maintaining lateral alignment of web employs a rotating mirror which reflects a light beam from a source of coherent light along a track across the web path. A mirror driven by a synchronous motor is located at the focal point of a parabolic reflector which converts the circular sweep of light from the mirror to rectilinear light that scans along the track and is incident on the track from the same direction all along the length of the track. A retro-reflector on the track reflects the light back to a detector. Thus the system generates an electrical pulse as the light beam crosses the web edge and this pulse is compared to the phase angle of the power driving the synchronous motor. This phase relationship is then used to develop an error signal to return the web to its reference location.

6 Claims, 4 Drawing Figures

WEB ALIGNMENT SYSTEM

BACKGROUND OF THE INVENTION

This invention relates to a web alignment system. It relates more particularly to a system which maintains very accurate alignment of a web edge or center line to a fixed reference point.

There are numerous web alignment systems which monitor the lateral position of a travelling web with respect to a reference point and control steering rollers or the like to shift the web laterally as needed to maintain the web edge or the web center line at that reference point.

A variety of devices are used to sense web position. These include photo-electric devices which detect light reflected from the web, various types of pneumatic devices which sense the presence of web by an increase in the back pressure at a nozzle positioned opposite the web path and various types of mechanical fingers which sense when the web strays laterally from the desired reference position.

All of these prior devices must be repositioned whenever the width of the web being run changes to any appreciable extent.

Some prior systems do include manual trim adjustments for accommodating small changes in web width, e.g. one-tenth inch or less. However, any appreciable width change requires the manual repositioning of the web sensors. This operation can be time consuming, particularly when the web sensors are situated in congested and relatively inaccessible locations in the line.

Also, often it is desirable to align the web being edge-position controlled with another web, which may or may not be edge-position controlled, in order to accurately laminate or combine the two webs with minimum edge trim or variation. Prior sensors cannot easily be used to provide a position trimming signal to enable a second sensor to detect the difference between the edge position of a master web and a slaved or follower web.

Still further-conventional devices of the general type must be located in close proximity to the web being guided. In many applications due to machine interferences this is difficult or impossible to accomplish.

Also, in many applications, the web is center-guided in that the web center line is maintained at the fixed reference position. These applications require two web sensors positioned at opposite sides of the web to produce a difference signal that compensates for minor variations in the linearity of the web edges. The requirement of two sensors not only increases the initial cost of these prior center-guided systems, but also means that twice as much time is needed to reposition the sensors when different width web is run.

For the foregoing reasons, the prior arrangements for controlling the lateral position of a web have not been entirely satisfactory and have resulted in excessive down-time of associated web processing apparatus between web changes.

SUMMARY OF THE INVENTION

Accordingly, it is an object of the present invention to provide an improved system for maintaining the center or edge alignment of a travelling web to either reference a web handling machine or another web.

Another object of the invention is to provide a system for maintaining accurate alignment of a travelling web through a fixed reference point.

Another object of the invention is to provide a web position scanning system which does not require that the web be maintained at a fixed distance from the scanner to achieve accurate position sensing, thereby simplifying mounting requirements.

Still another object to the invention is to provide a web alignment system which indicates web position error.

Yet another object of the invention is to provide a system of this type which is relatively easy to install on existing web handling equipment and which can be controlled from a readily accessible remote location.

Another object is to provide a web position scanning system which can be readily interfaced with existing means for lateral web displacement to yield stable web positioning control with a variety of such displacement means.

Another object is to provide a web position detector which gives stable web positioning control when the web position correction means are located remotely from the detector.

Other objects will in part be obvious and will in part appear hereinafter. The invention accordingly comprises the features of construction, combination of elements and arrangement of parts which will be exemplified in the construction hereinafter set forth, and the scope of the invention will be indicated in the claims.

Briefly, the present system includes a source of color coherent light whose beam is incident on a flat rotary mirror positioned at the focal point of a single surface parabolic reflector spaced directly opposite the path of the moving web.

When the mirror is rotated, the light reflected from the mirror scans along the parabolic reflector during a portion of each mirror revolution so that the circular moving light from the mirror is converted by the reflector into rectilinear moving light that sweeps along a track transverse to the web path. The reflector thus assures that the light beam that scans across the web path remains perpendicular to the web path.

In some applications in which the web distance from the mirror remains constant, the parabolic reflector is not required.

The system components are oriented relative to the web path and a retro-reflector located adjacent the web path so that the light from the rotating mirror or parabolic reflector is normally blocked by the web and is not incident on the retro-reflector. When portions of the retro-reflector are not blocked by web, light is reflected by the retro-reflector to a photo-detector which thereupon produces an output pulse.

The system employs a synchronous motor to rotate the mirror so that the position of the light beam along its track across the web path is fixed relative to the power line voltage driving the motor. Timing pulses are generated when the power line voltage crosses the zero voltage level. By comparing the time relationship of the pulse generated by the detector when the light beam scans across the edge of the web, with the appropriate zero crossing pulse, the web position relative to the power line voltage and therefore the scanning motor shaft position is determined. An adjustable phase shift circuit is provided to position the zero crossing pulses so that the motor shaft and hence the scanning mirror establish the desired scanning track of the retro-reflector. As the web shifts position laterally in the web path, i.e. with respect to the reference point, the pulse generated by the detector changes its position relative to the power line zero crossing reference pulses.

This timing relationship between the detector pulse and zero crossing pulses is converted to an analog voltage, the polarity of which determines the direction of correction required and the magnitude of which determines the amount of correction required. This analog voltage is further processed to provide relay closures which are time proportioned to cause a motor (or other controlling means) to shift the web laterally an amount approximately equal to the measured edge position error to return the web edge to the reference position. The correcting motor can drive either a web steering roller or roller assembly or it can move an entire roll stand as required to maintain the desired web edge position.

The present system may be installed on machines having existing means for lateral web positioning which often are a considerable distance from the web edge sensor. To provide for this contingency, the system locks out further corrections after a correction has been made, until approximately the number of feet of web equal to the distance between the sensor location and the correction location have passed the sensor thereby preventing hunting due to the over-correction of a measured error.

The system also provides for the convenient remote repositioning of the web edge by substantial amounts without the need for the physical repositioning of the scanner. In addition, web edge position readout is provided. Another desirable feature of this invention is that web edge position at one point in a machine line can be slaved to follow web edge positions at other points in the machine. This allows for the alignment of one web to another such as is required, for example, on corrugating machines to align the bottom liner to the single face material.

BRIEF DESCRIPTION OF THE DRAWINGS

For a fuller understanding of the nature and object of the invention, reference should be made to the following detailed description, taken in connection with the accompanying drawings, in which.

DESCRIPTION OF THE PREFERRED EMBODIMENTS

Figure 1:
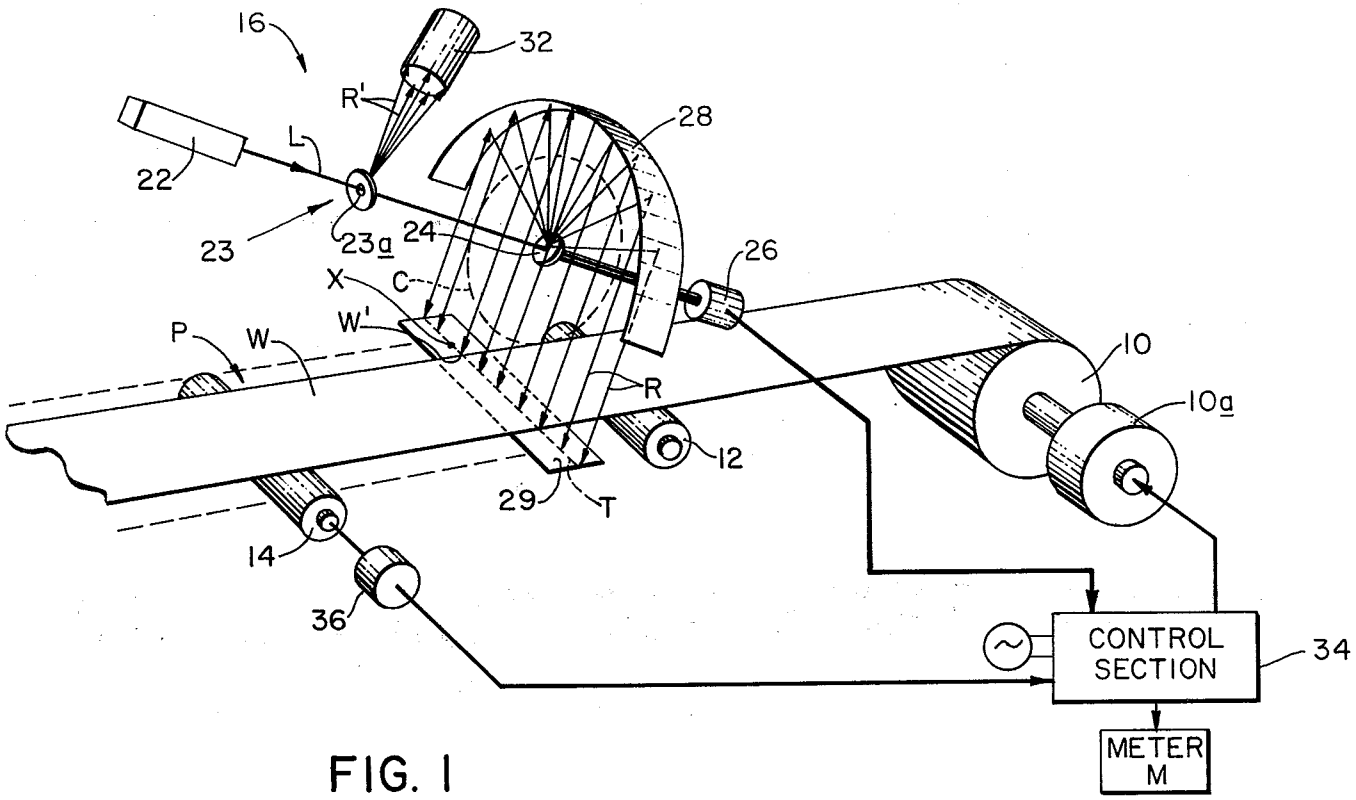
FIG. 1 is a diagrammatic view of a web alignment system made in accordance with this invention.

Turning now to FIG. 1 of the drawings, a web W drawn from an unwind stand 10 follows a generally horizontal path P which takes it over a pair of guide rollers 12 and 14 spaced along the path. Thence the web is drawn into a web-consuming machine (not shown), such as a printing press, for example.

The system for maintaining the alignment of web W is positioned above the web and indicated generally at 16. The system monitors the lateral position of the web edge or the web centerline along an imaginary track T transverse to the web path P. Assume, for example, that it is desired to maintain the position of web W on the track so that its left-hand edge W′ is positioned at point X on the track. System 16 monitors the position of that edge relative to point X. When web edge W′ moves away from point X, the system controls a reversible correction motor **10*a* of unwind stand 10,** to shift the unwind stand (and thereby shift the web) laterally to return the web edge W′ to the reference point X.

Alignment system 16 includes a source 22 of collimated light such as a laser. The source directs a beam of light L through a hole **23*a* in a 45° mirror 23 positioned above the web path P toward a flat mirror 24 oriented at an angle of 45° relative to the light beam L. Mirror 24 is mounted for rotation, say, in a clockwise direction, about an axis coincident with that of beam L by a synchronous motor 26. The instantaneous line voltage and polarity applied to motor 26 thus give an indication of the angular position of mirror 24** about its axis.

As motor 26 rotates mirror 24, the light beam L, from laser 22, is reflected from the mirror so that it sweeps around in a circle indicated by dotted lines at C in FIG. 1. System 16 also includes a single surface parabolic reflector 28 positioned above the web path P so that its focal point lies at the center of circle C., i.e. at the axis of rotation of mirror 24. Thus the light L reflected from mirror 24 sweeps along reflector 28 during a portion of each revolution of the mirror.

Reflector 28 reflects this light down toward the web path P and more particularly toward track T as indicated by rays R. A retro-reflector 29 such as a reflective tape is located at track T just under the web path. When the light beam L is scanning a portion of track T at which web is not present, the light beam is reflected by the retro-reflector. On the other hand, when the beam is scanning a portion of track T at which web is present, the web prevents light from being incident on the retro-reflector 29.

The elements of the alignment system 16 are oriented relative to the web path P so that the light beam L is incident on the track T from a slight angle. The retro-reflector 29 reflects light essentially back along the path of the incident light. In other words, the light is reflected back via the parabolic reflector 28 to the rotating mirror 24. The light from mirror 24 is then directed toward the reflective surface of mirror 23 and reflected thereby as rays R′ to a photosensor 32 positioned above the web path P.

Still referring to FIG. 1, system 16 also includes a control section 34 which develops a signal proportional to the position error between the web edge W′ location on track T and the selected referenced point X. This signal is processed to provide an output to the unwind stand correction motor **10*a* which causes motor 10*a* to run in the proper direction and for the correct time interval to shift stand 10** and return the web edge W′ to the selected reference point X. As will be seen presently, reference point X can be adjusted by the operator and the setting displayed on a meter M.

Since the present web alignment system may be retrofitted on existing web handling equipment, the point where the web displacement is sensed, i.e., the location of track T may be more or less removed from the point at which the correction of web displacement takes place, i.e. the position of unwind stand 10. Accordingly, as will be described in detail later, a revolution detector 36 that detects revolutions of roller 14 applies a signal to control section 34 to prevent that section from feeding correction signals to motor **10*a* for a time interval equal approximately to the time required for the web W to move from the correcting location at roll stand 10 to the sensing location at track T. This minimizes hunting by motor 10***a* due to overcorrection of a measured web edge position error at track T.

Figure 2:
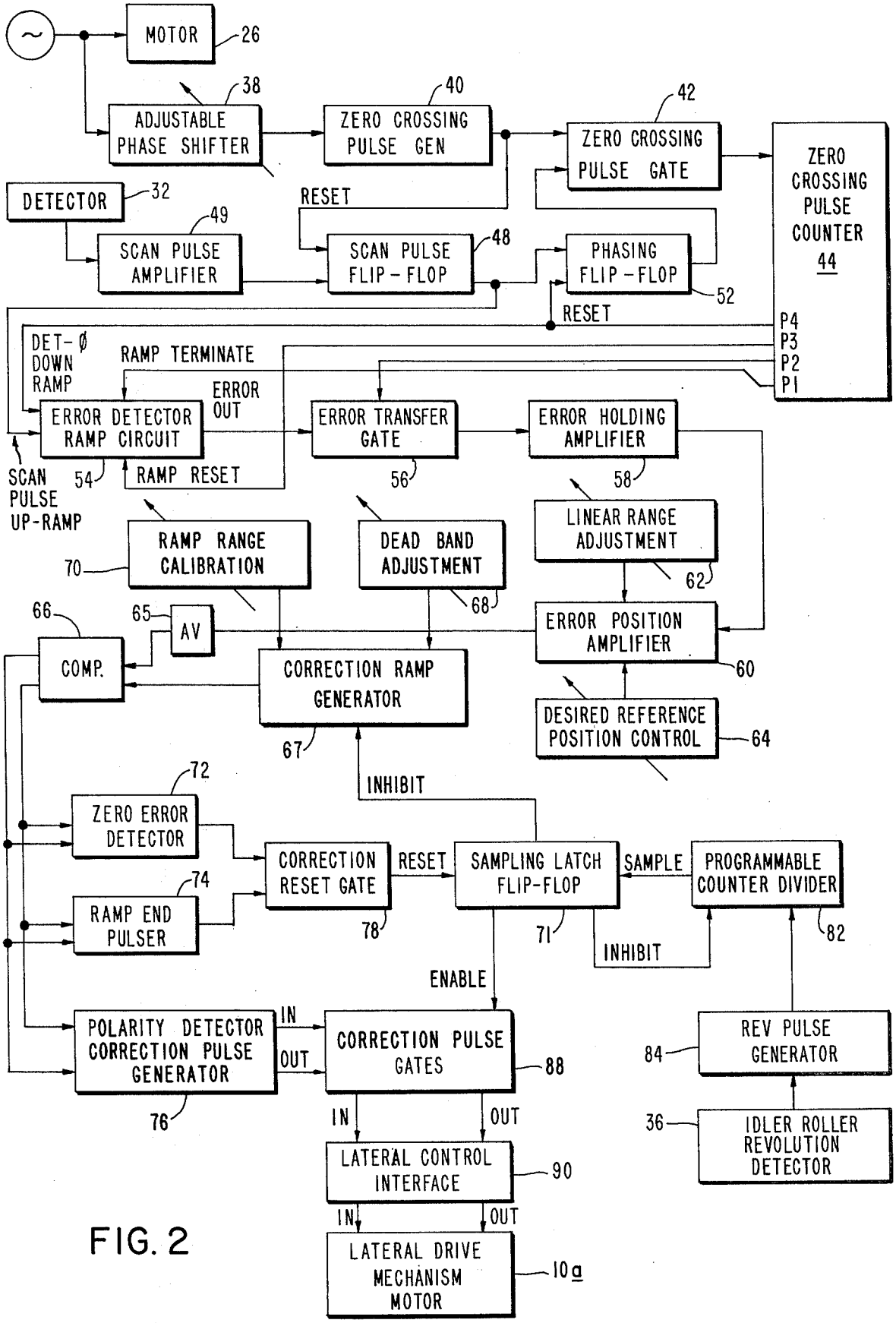
FIG. 2 is a block diagram illustrating the system control section in greater detail.
Figure 3:
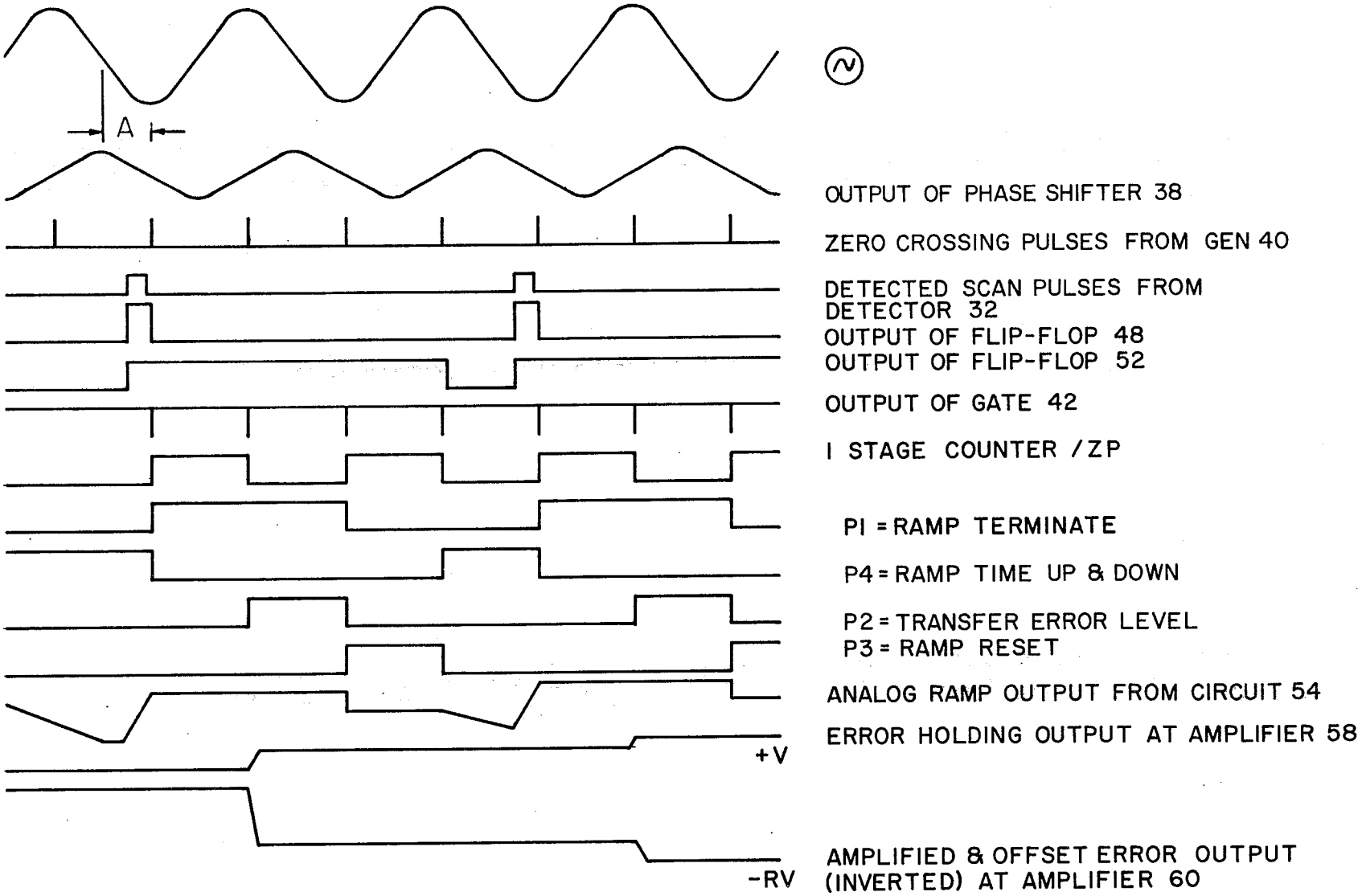
FIG. 3 is a timing diagram clarifying operation of the system.
Figure 4:
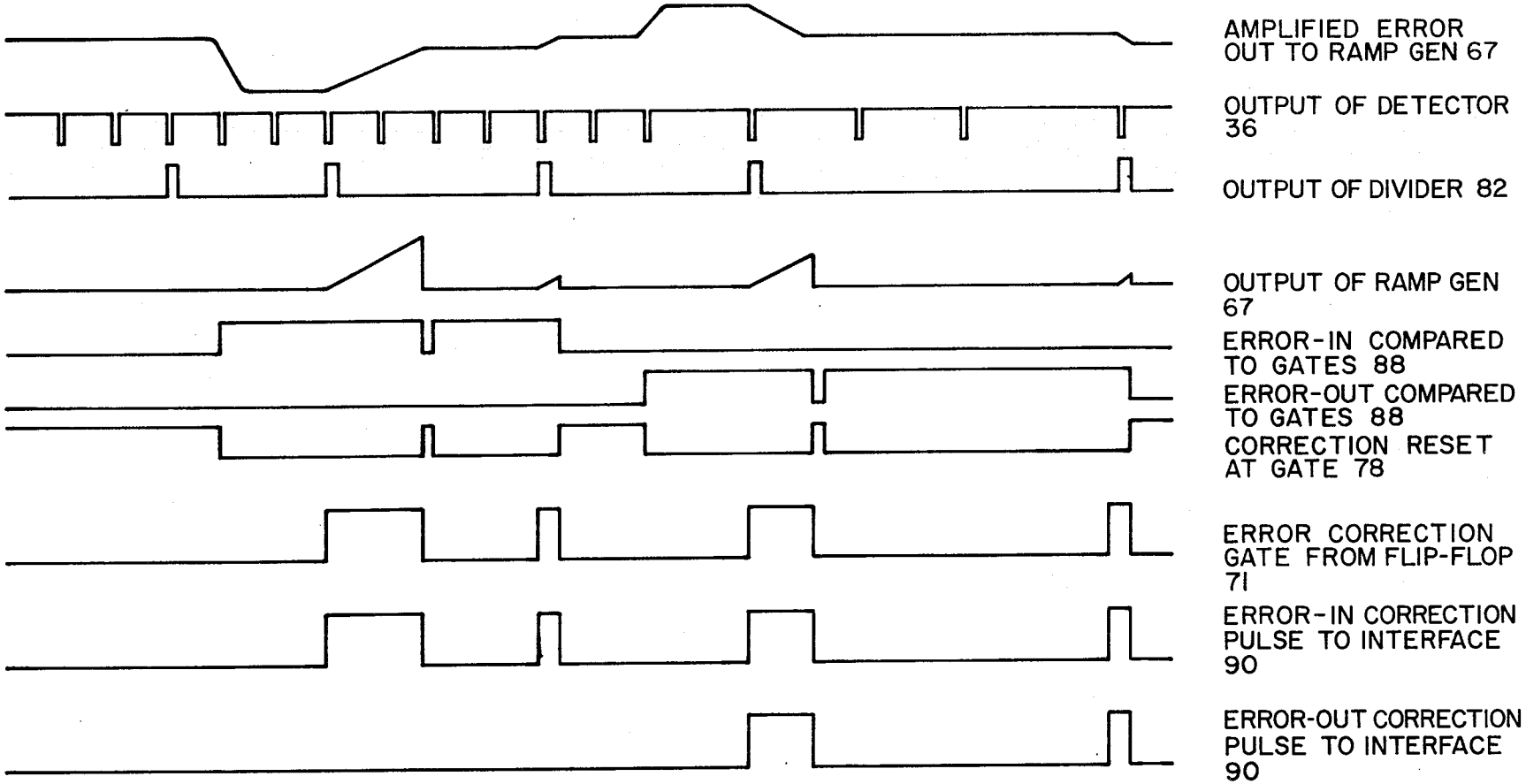
FIG. 4 is a similar diagram showing the timing of other components of the system.

The operation of control section 34 can best be understood by referring to the FIG. 2 block diagram and the FIGS. 3 and 4 timing diagrams which help to explain the functions of the various elements in FIG. 2.

The line voltage which powers the scanning mirror motor 26 is applied via an adjustable phase shifter 38 to a zero crossing pulse generator 40. Each time the phase shifted supply voltage crosses the zero voltage level, generator 40 generates a train of pulses. Phase shifter 38 shifts the supply voltage phase through a selected angle A as required to establish the proper phase relationship between the line voltage and the angular position of mirror 24. More particularly, the phase shifter is adjusted so that without web W to block the scanning light beam, the beam reflected by reflector 29 will reach the end of the reflector 29 and thus terminate at the time of a zero crossing pulse from generator 40.

The pulses from generator 40 are applied by way of a zero crossing pulse gate 42 to a counter 44. Pulses from generator 40 are also applied to the reset input of a scan pulse flip flop 48 which receives signals from photosensor 32 by way of an amplifier 49. Flip flop 48 which is set by a signal from detector 32 sets a phasing flip flop 52 which thereupon applies an enabling signal to gate 42.

Thus each time mirror 24 scans along track T, flip flop 48 produces an output signal which is initiated when the photosensor 32 first detects light as the light beam moves from the nonreflective web edge W′ to the retroflector 29. That signal terminates when the scanning light beam reaches the end of reflector 29 and flip flop 48 is reset by a zero crossing pulse from pulse generator 40.

The signal from flip flop 48 sets flip flop 52 so that a selected member of zero crossing pulses from generator 40 are applied to counter 44. Counter 44 counts these pulses and the first four pulses designated P1 to P4 appear on four separate output lines, with the fourth pulse P4 being applied to reset flip flop 52. Thus each scan (cycle), four zero crossing pulses are selected by counter 44. Also, during each scan, flip flop 48 develops an output signal whose duration represents web position error, i.e. the distance between the web edge W′ and reference position X. This signal is applied to the ramp down input of an error detector ramp circuit 54. The output is circuit 54 is, in turn, applied by way of a gate 56 to an error holding amplifier 58. Then, the ramp generated by circuit 54 which is initiated by the signal from flip flop 48 is terminated by a P1 pulse from counter 44. Thereupon the voltage level of the output circuit 54, reflecting web position error, is gated to holding amplifier 58 by the second zero crossing pulse P2 which is applied by counter 44 to enable gate 56. The next zero crossing pulse P3 selected by counter 44 is applied to reset ramp circuit 54. Consequently the output of the circuit 54 drops to zero volts which is not applied to amplifier 58 since gate 56 is disabled at this point.

Finally zero crossing pulse P4 which is selected by counter 44 is applied to reset flip flop 52 as described previously and is also fed to the ramp-down input of ramp circuit 54 so that the output of that circuit ramps down from zero volts to which it was previously set as seen in FIG. 3. Gate 56 remains disabled until the occurrence of the next zero crossing pulse P2 from counter 44.

To recapitulate at the beginning of each scan, at P1, ramp circuit 54 develops a web position error-indicating ramp signal. At P2 the ramp signal is terminated and the voltage at the output of circuit 54 reflects the error during that scan. At P3 that voltage is gated into holding amplifier 58 and finally at P4, the ramp circuit 54 is reset for the next scan. The output of circuit 54 is reset to a negative-going ramp rather than to zero volts so that the system will recognize a zero error condition that would produce a zero output from circuit 54. Thus the output from ramp circuit 54 during each scan cycle is proportional to the distance between the position of web edge W′ as sensed by photosenser 32 and the reference point X. Further, the polarity of this voltage signal indicates whether the web position error is either to the right or to the left (i.e. outward or inward) of reference point X. Also during each scan, the error signal from circuit 54 is applied to holding amplifier 58 so that the error-indicating voltage in amplifier 58 is constantly updated.

The output of amplifier 58 is fed to an error position inverting amplifier 60. The system includes a linear range adjustment 62 which permits calibration of the gain of amplifier 60 so that the output linear voltage range from that amplifier is proportional to a desired linear web edge position error range.

Also a variable reference position control 64, in the form of a potentiometer, permits applicaion of a voltage offset to the signal in amplifier 60. The setting of control 64 permits the operator to select the location of the web edge reference point X. As noted previously, the setting of point X is conveniently displayed on a meter M (FIG. 1). Thus the voltage setting of position control 64 is compared in amplifier 60 to the output of holding amplifier 58 and multiplied by the ratio of the range adjustment 62 voltage to produce a voltage level which is applied by way of an absolute value circuit 65 to a comparator 66.

Comparator 66 also receives the output of a ramp generator 67 which is enabled by signals from a sampling latch flip flop 71. During each scan cycle, the output of generator 67 is a voltage ramp whose size is proportional to the web position error, as seen in FIG. 4.

A dead band adjustment 68 i.e. a potentiometer, permits application of a small voltage offset from zero volts to the output of generator 67 also as seen in FIG. 4 to permit the system not to respond to errors that are so minor that they can be ignored. Also, an adjustable ramp range calibration 70 permits further adjustment of the signal generator 67 to provide an output signal which achieves a practical amount of movement of roll stand 10 for a given sensed web position error. Thus the output of ramp generator 67 is the result of the settings of adjustment 68 annd calibration 70. Further, the timing of the ramp output from generator 67 is controlled by the output of latch flip flop 71.

The signal from comparator 66 is applied to a zero error detector 72, and a ramp end pulser 74. The output of the error detector is applied by way of a reset gate 78 to the reset input of the sampling latch flip flop 71. Gate 78 is enabled at the end of each ramp from comparator 66 by a pulse from pulser 74. Thus during each scan cycle, if a zero error is detected by detector 72, latch flip flop 71 is reset thereby applying an inhibit signal to generator 67 preventing generation of a further error signal during that scan cycle. Flip flop 71 remains reset until detector 72 detects a web position error during the next scan cycle.

In addition, flip flop 71 receives an output sample signal from a programmable counter/divider 82. Counter/divider 82 counts pulses from a pulse generator 84 which responds to the output of roller revolution detector 32. The detector generates a pulse for each such revolution of the roller as indicated in FIG. 4.

The revolution detector 36 generates pulses proportional to the linear web runoff from roll stand 10. These are conditioned by pulse generator 84 and applied to counter/divider 82. The counter/divider 82 is pre-programmed to divide the number of pulses from generator 84 to produce a signal whose frequency is proportional to the length of web between roll stand 10 where correction takes place and track T where web position error is sensed. Thus the sample from counter/divider 82 is a signal which is speed regulated as well as linearly initiated.

Thus the counter/divider 82 is inhibited as long as flip flop 71 is set which indicates that the last correction is still in process. On the other hand, when flip flop 71 is reset, the output from counter/divider 82 will apply a sample signal to set flip flop 71 unless no error is detected by detector 72.

A polarity detector/pulse generator 76 receives both web position error and ramp signals from comparator 66 and generates proportional correction pulses that are issued on either an IN or an OUT output line depending upon whether the web edge W′ is inboard or outboard of the desired reference position X. These correction signals are applied by way of gates 88 to a lateral control interface 90. Interface 90 consists simply of appropriate conventional switching devices that are capable of driving lateral drive motor 10*a* in the proper direction to correct each web position error sensed.

As seen in FIG. 4, if web edge W′ is not at the reference point X, generator 76 will receive an error signal every third pulse from divider 82 unless a correction is in process. Accordingly, the location of the web is monitored very closely so that position errors are kept to a minimum.

It will be apparent from the foregoing then, that the web alignment system described herein controls web position quite accurately, i.e. typically within one-thirtysecond inch, because it uses a highly collumated light source which scans the web at a uniform rate. Because of the utilization of parabolic reflector 28, the system can accommodate variations in the distance between the web W and the scanning mirror 24. In those applications where the web W can be maintained at a substantially fixed distance from mirror 24, the reflector 28 is not required, the angular sweep of the light being sufficient for the detection system.

In the event that web W is being held to register with a second web, as in a corrugator, two scanners are employed. One scanner develops a signal proportional to the error between the edge of the first web and a reference position X. A second scanner, complete with the control section 34 is then used to reference the edge of the second web to the edge of the first web.

Also it is possible to use the present system to maintain alignment of the web centerline with a selected reference position. In this event, the scanner scans over both edges of the web and develops two error pulses in much the same manner described above. Then the system maintains a match between the error signals, the outputs from two ramp generators 67 being coupled to a differential to apply the appropriate correction signal to motor 10*a*.

Furthermore, the system is independent of the width of the web in the sense that there need be not repositioning or realignment of light sources, web sensors or the like when running webs of different widths. Still further, the alignment system disclosed herein is constructed for the most part of standard electrical components which are readily available. Consequently, the cost of retrofitting existing presses and other web consuming apparatus with the system is not excessive. Accordingly, the system should find use in many web-handling applications.

It will thus be seen that the objects set forth above, among those made apparent from the preceding description, are efficiently attained. Also, certain changes may be made in the above constructions without departing from the scope of the invention. For example, the detector may be positioned on the opposite side of the web from the mirror 24 and detect the absence of web to determine the location of the web edge along the track. Accordingly, it is intended that all matter contained in the above description or shown in the accompanying drawings be interpreted as illustrative and not in a limiting sense.

It is also to be understood that the following claims are intended to cover all of the generic and specific features of the invention herein described.

We claim:

1. A system for maintaining lateral alignment of web travelling along a path comprising A. a light beam source, B. means for scanning the light beam from the source along a track across the web path so that the beam is intercepted by web only on those portions of the track where web is present, said scanning means including 1. a parabolic reflector positioned opposite the web path,
2. a mirror positioned at the focal point of the reflector and oriented to direct the light beam from the light beam source toward the reflector, and
3. means for rotating the mirror at a constant rate so that the circular sweep of light from the mirror is converted by the reflector to rectilinear light that scans along said track at a constant incident angle C. means positioned to detect the beam scanning along the track and producing an output signal depending upon the presence or absence of web, D. means for detecting when the beam scans through a selected position on the track and producing a second output signal in response thereto, and E. means for producing a web position error signal dependent upon the time interval between the first and second signals.

2. The system defined in claim 1 and further including

A. means for shifting web laterally in the web path, and

B. means for controlling the shifting means in accordance with the error signal so that the shifting means shifts by the required amount to reduce the web position error.

3. The system defined in claim 1 wherein the light beam source comprises a laser.

4. The system defined in claim 1 wherein the rotating means comprise a synchronous motor so that the line frequency voltage applied to the motor provides a direct indication of the angular position of the mirror and therefore the position of the light beam on the track.

5. The system defined in claim 4

A. wherein the detecting means detect the zero axis crossing of the line voltage, and B. further including means for causing the axis crossing to occur at the instant the light beam is scanning through said selected position.

6. A system for maintaining lateral alignment of web travelling along the path comprising A. a light beam source, B. means for scanning the light beam from the source along the track across the web path so that the beam is intercepted by web only on those portions of the track where web is present, C. means positioned to detect the beam scanning along the track and producing an output signal depending upon the presence or absence of web, D. means for detecting when the light beam scans through a selected position on the track and producing a second output signal in response thereto, E. means for producing a web position error signal dependent upon the time interval between the first and second signals, F. means for shifting web laterally in the web path, G. means for controlling the shifting means in accordance with the error signal so that the shifting means shifts by the required amount to reduce the web position error, and H. means for inhibiting the error signals from the producing means to the controlling means during the time it takes for a web edge point detected out of position to travel from said shifting means to said track.

* * * * *